US009702180B2

(12) United States Patent
Im

(10) Patent No.: US 9,702,180 B2
(45) Date of Patent: Jul. 11, 2017

(54) DRIVING MODULE OF POWER TRUNK

(71) Applicant: HYUNDAI MOTOR COMPANY, Seoul (KR)

(72) Inventor: Yong Hyuck Im, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/959,644

(22) Filed: Dec. 4, 2015

(65) Prior Publication Data

US 2016/0194911 A1 Jul. 7, 2016

(30) Foreign Application Priority Data

Jan. 5, 2015 (KR) ..... 10-2015-0000501

(51) Int. Cl.
*E05F 15/614* (2015.01)
*E05D 5/06* (2006.01)

(52) U.S. Cl.
CPC ..... *E05F 15/614* (2015.01); *E05D 5/062* (2013.01); *E05D 2005/067* (2013.01); *E05Y 2201/626* (2013.01); *E05Y 2201/712* (2013.01); *E05Y 2900/546* (2013.01)

(58) Field of Classification Search
None
See application file for complete search history.

(56) References Cited

U.S. PATENT DOCUMENTS 6,135,536 A * 10/2000 Ciavaglia ..... E05F 15/614 296/106
6,955,390 B2 * 10/2005 Rigorth ..... E05F 15/63 296/146.4
7,355,365 B2 * 4/2008 Platzkoester ..... E05F 15/63 296/76
8,414,058 B2 * 4/2013 Duffy ..... E05D 5/062 296/76
9,174,517 B2 * 11/2015 Scheuring ..... B60J 5/047
9,222,296 B2 * 12/2015 Hamminga ..... E05F 15/622
2003/0038500 A1 * 2/2003 Aubry ..... E05F 15/619 296/76
2004/0256881 A1 * 12/2004 Takeda ..... E05F 15/63 296/146.2
2006/0261626 A1 * 11/2006 Okada ..... E05F 15/611 296/76
2010/0275518 A1 * 11/2010 Nakazato ..... E05D 5/062 49/386
2012/0000304 A1 * 1/2012 Hamminga ..... E05F 15/41 74/89.23

FOREIGN PATENT DOCUMENTS

JP 2001-039342 A 2/2001
KR 10-2010-0051848 A 5/2010
KR 10-1105465 B1 1/2012
KR 10-2013-0099404 A 9/2013

* cited by examiner

*Primary Examiner* — Katherine Mitchell
*Assistant Examiner* — Marcus Menezes
(74) *Attorney, Agent, or Firm* — McDermott Will & Emery LLP

(57) ABSTRACT

A driving module of a motor-driven power trunk includes a pivotable lid hinge configured to open or close the trunk lid. A main arm is pivotably installed in a vehicle body. A sub arm constrains the lid hinge and is linked to the main arm. A motor is provided on the main arm and is configured to pivot the main arm and the sub arm so as to automatically open or close the trunk lid.

4 Claims, 13 Drawing Sheets

--PRIOR ART--

--PRIOR ART--

--PRIOR ART--

--PRIOR ART--

--PRIOR ART--

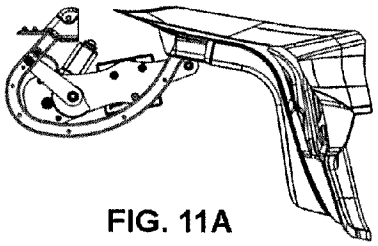
FIG. 11A
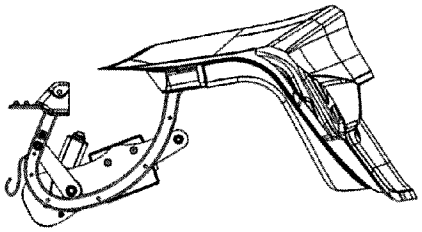
FIG. 11B
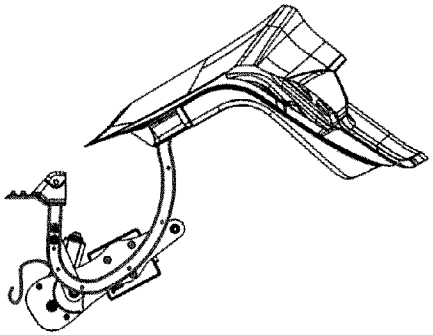
FIG. 11C
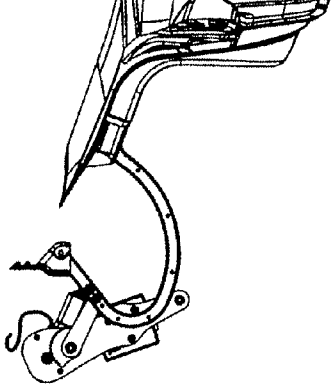
FIG. 11D
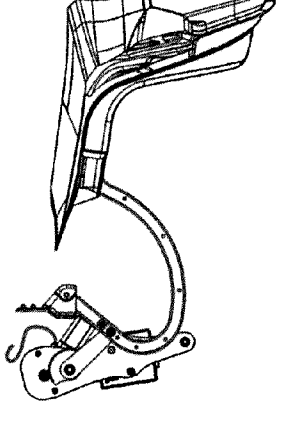
FIG. 11E
FIG. 11F

DRIVING MODULE OF POWER TRUNK

CROSS-REFERENCE TO RELATED APPLICATION

This application claims under 35 U.S.C. §119(a) the benefit of priority to Korean Patent Application No. 10-2015-0000501 filed on Jan. 5, 2015, the entire contents of which are incorporated herein by reference.

TECHNICAL FIELD

The present invention relates to a power trunk, and more particularly, to a driving module of a power trunk that allows for ease of assembly and saves weight and cost.

BACKGROUND

In general, a trunk room for storing parcels, emergency tools, a spare tire, and the like is provided at a rear of a vehicle and a trunk lid covers the trunk room forming a trunk.

The trunk is locked or unlocked by a locking device to be opened/closed and is hinge-configured so that the trunk lid is easily lifted up only by the unlocking.

Meanwhile, in recent years, a power trunk in which the trunk is automatically opened/closed merely by an operation at a driver's seat has been developed.

The power trunk is a vehicular trunk apparatus which automatically open/close a door by using an electric motor and an application thereof has been gradually extended due to achievement of high quality vehicles and development of additional functions.

With such a tendency, Korean Patent Unexamined Publication No. 10-20130099404 (Trunk Opening/closing Apparatus) has been proposed and in the related art, as illustrated in FIGS. 1 and 2, provided is a power trunk module that includes: a base plate installed in a vehicle body; a motor installed on the base plate and providing power; a driving gear installed on a motor shaft of the motor; a driven gear installed on the base plate and engaged in the driving gear; a main arm transferring power to a trunk lid, and a clutch installed between the main arm and the driven gear to cut off power when opening the trunk lid and transfer power when closing the trunk lid.

The base plate in the related art is fixed to the vehicle body at three points to support the motor and when the motor rotates, a lid hinge is pushed by coupling the main arm and a sub arm to each other by four links to open/close the trunk lid, but according to FIG. 3A, an operator needs to perform a process of lifting a power trunk lid (PTL) module and provisionally load the PTL inside the vehicle body, but since the PTL module has a significant weight, the PTL is very difficult to provisionally load.

As a second process, according to FIGS. 3B and 3C, since three points of the base plate need to be mounting-assembled to the vehicle body through a tool, inconvenience of provisional loading while fastening needs to be endured, and as a result, it takes a significantly long time in fastening.

As a third process, installation is completed by coupling the lid hinge and the sub arm through a ball joint, but a whole eight of the PTL is very large and the volume of the PTL is significant, and constituent elements are a lot to increase cost by manufacturing and an installation time is extended due to an increase in the number of operations for installation in the vehicle body to cause personnel expenses to increase.

The above information disclosed in this Background section is only for enhancement of understanding of the background of the invention and therefore it may contain information that does not form the prior art that is already known in this country to a person of ordinary skill in the art.

SUMMARY

The present invention has been made in an effort to solve the above-described problems associated with prior art and, in certain embodiments, to provide a driving module of a power trunk that removes the need for a base plate fixedly installed in a vehicle body and configures a PTL by making a main arm substitute for a function thereof to enhance unfavorable workability depending on an illogical assembly location in the related art and save a weight by the deletion of the base plate save cost thereby.

In one aspect, an embodiment of the present invention provides a driving module of a motor-driven power trunk in a vehicle. A pivotable lid hinge is configured to open or close a trunk lid. A main arm is pivotably installed in a body of the vehicle. A sub arm constrains the lid hinge and is linked to the main arm. A motor is provided on the main arm and is configured to pivot the main arm and the sub arm so as to automatically open or close the trunk lid.

In certain embodiments, the main arm has opposing first and second sides, and a first through-hole is formed at the first side of the main arm. The first through-hole is configured to receive a first fastening bolt configured to pivotably fasten the main arm to the vehicle body. A second through hole is formed at the second side of the main arm. The second through hole may be configured to receive a motor shaft of the motor axially coupled with a driving gear.

In certain embodiments, the sub arm includes a sector gear and a link rod.

The embodiments of the present invention configured as above are provided to enhance unfavorable workability depending on an illogical assembly location in the related art, and save a weight depending on deletion of a base plate and save cost thereby.

Other aspects and preferred embodiments of the invention are discussed infra.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein:

FIGS. 11A-11F illustrate intermediate positions during an opening of a power trunk lid.

Figure 1:
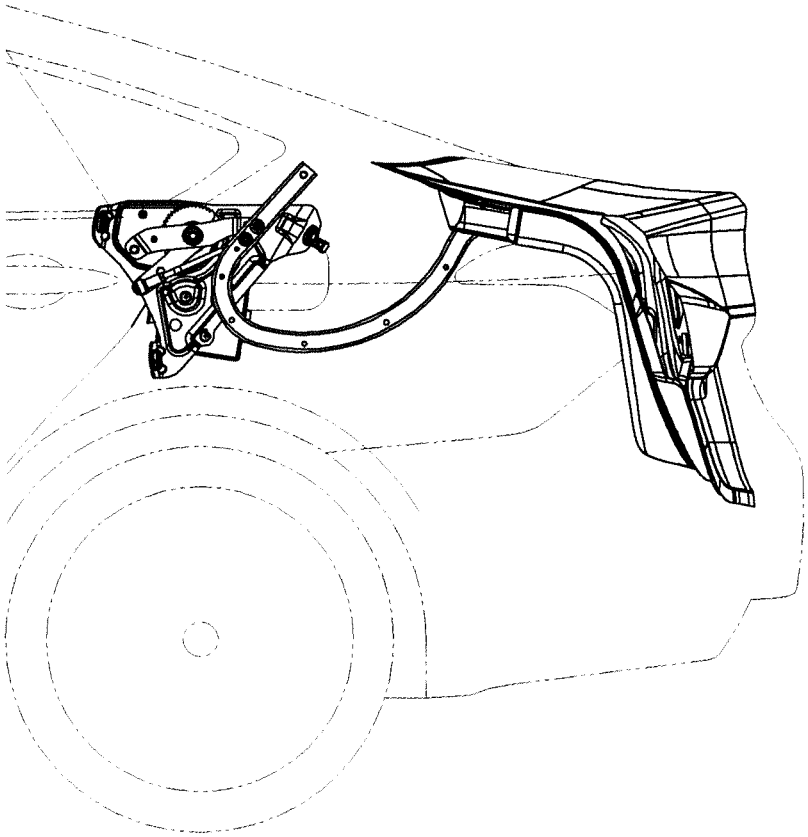
FIGS. 1 and 2 are installation operation state diagrams of a power trunk module in the related art.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Embodiments of the present invention will be described more fully hereinafter with reference to the accompanying drawings, in which embodiments of the invention are shown.

A driving module 100 of a power trunk of an embodiment of the present invention pivots a lid hinge 151 to open/close a trunk lid 150 with a power source of a motor 120 as illustrated in FIGS. 4 to 7C.

Herein, a main arm 110 is rotatably installed in a vehicle body 200 and the lid hinge 151 of the trunk lid 150 is constrained and a sub arm 130 is linked to the main arm 110.

In certain embodiments, the motor 120 that pivots the main arm 110 and the sub arm 130 has been already installed in the main arm 110 so as to automatically open and close the trunk lid 150.

In certain embodiments, the main arm 110 elongates in a wide panel shape having a gourd bottle shape and has holes which penetrate at both sides thereof for pivotable coupling, and a hole having a relatively smaller width is pivotably coupled through coupling to the vehicle body through bolt and nut fastening and the motor 120 is installed in a hole having a relatively larger width and a shaft that protrudes from the motor penetrates the hole of the main arm 110, and as a result, a driving gear 123 is axially coupled to and installed in an opposite side.

In certain embodiments, a first through-hole 111 for pivotably installing the main arm 110 in the vehicle body 200 through fastening of a first fastening bolt B1 (shown in FIG. 7B) and a second through hole (not illustrated) which a motor shaft 121 of the motor 120 to be axially coupled with the driving gear 123 are respectively penetratively formed at both sides of the main arm 110.

Further, in certain embodiments, the sub arm 130 engages with the driving gear 123 and is axially coupled to a first hinge hole 115 of the main arm 110 by a second fastening bolt B2 to form a sector gear 131 that rotates by drive force of the motor 120 and one end portion is linked to a second hinge hole 152 of a lid hinge 151 to pivot the lid hinge 151 by the rotation of the sector gear 131 and has a link rod 133 that rotates similarly along the sector gear through coupling with a fixation protrusion 133*a* corresponding to a fixation hole 131*a* of the sector gear 131.

In addition, in certain embodiments, the main arm 110 is gradually widened from the first through hole 111 to the second through hole. In certain embodiments, multiple fastening holes 117 (not illustrated) are formed in the main arm 110 to receive at least one fixation screw S to fasten the main arm 110 to the motor 120 or an ECU 160, or to both the motor 120 and the ECU 160. In certain embodiments, the main arm 110 is a gourd-bottle-shaped plate.

Therefore, in certain embodiments, the motor 120 that is installed at the other one end of the main arm 110 to provide power is provided and the driving gear 123 that is connected to the motor shaft 121 of the motor 120 to transfer the power of the motor 120 is connected to the main arm 110.

Meanwhile, in certain embodiments, the ECU 160 is further provided on one surface of the main arm 110, and is installed adjacent to the motor 120 and supplies power and issues an order so that the motor 120 is driven.

In certain embodiments, the sector gear 131 is provided, which is rotatably installed in a part of the main arm 110 and engaged with the driving gear 123 to rotate in response to the rotation of the driving gear 123.

In addition, in certain embodiments, the link rod 133 is included, of which one end portion is linked to the lid hinge 151 and is stacked on and fastened to the sector gear 131 and extends in one circumferential direction to rotate the lid hinge 151 with the rotation of the sector gear 131.

In certain embodiments, the sub arm 130 is installed in such a manner that the sector gear 131 and the link rod 133 are detachable by the second fastening bolt B2 and the fixation hole 131*a* is penetratively formed at one side of the sector gear 131 and a fixation protrusion 133*a* may protrude from the link rod 133 so that the sector gear 131 and the link rod 133 together move while being integrally coupled with each other to correspond to the fixation hole 131*a*.

As described above, detailed effects and operations in the configured present invention will be described in detail with reference to the accompanying drawings.

Figure 2:
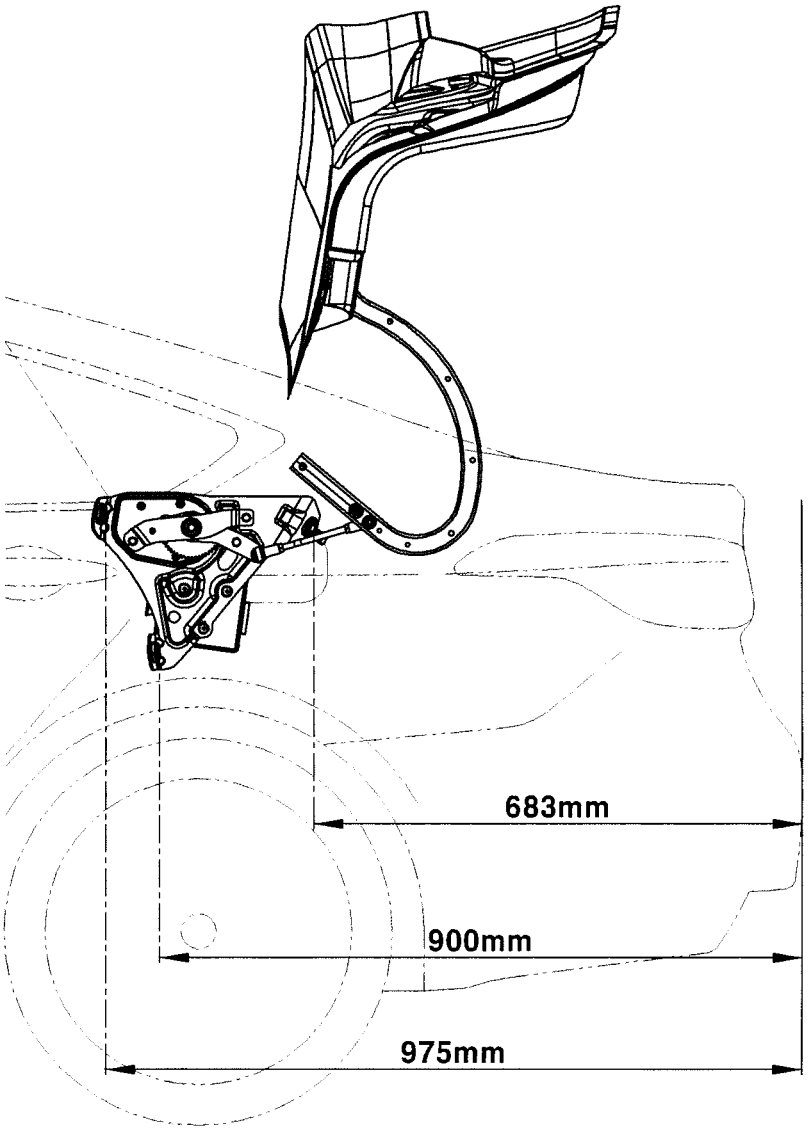
Figure 3A:
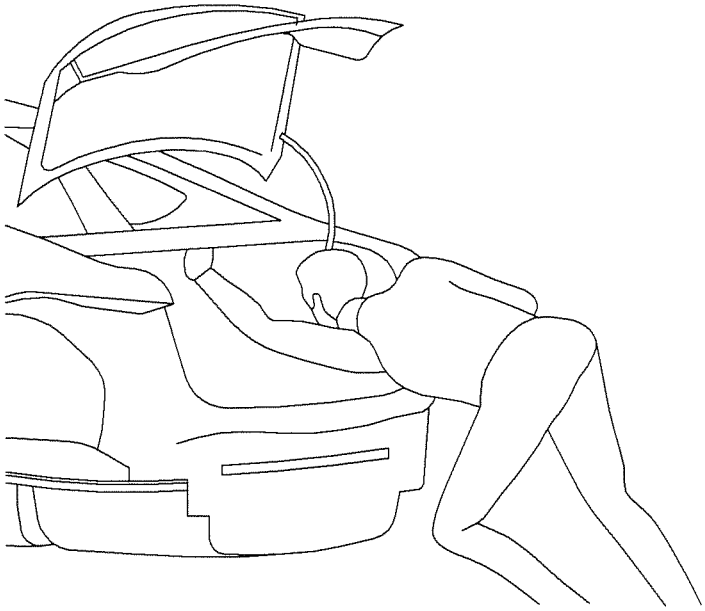
FIGS. 3A, 3B, and 3C are exemplary diagrams depending on an installation process of the power trunk module in the related art.
Figure 3B:
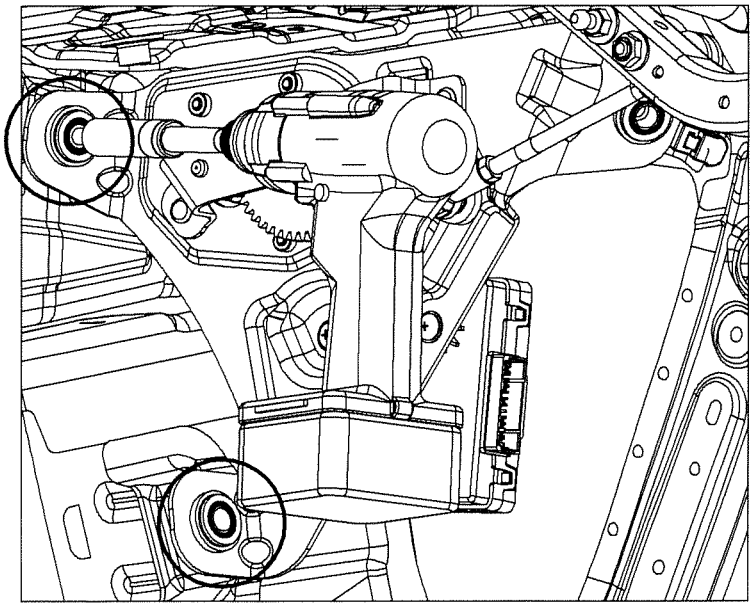
Figure 3C:
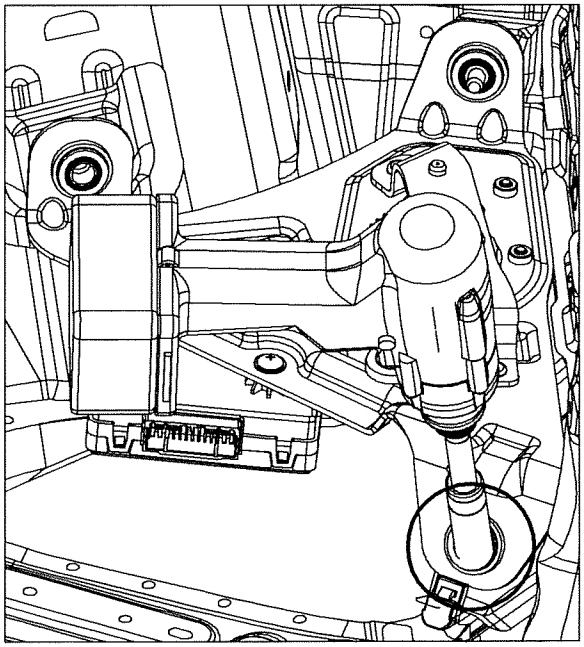
Figure 4:
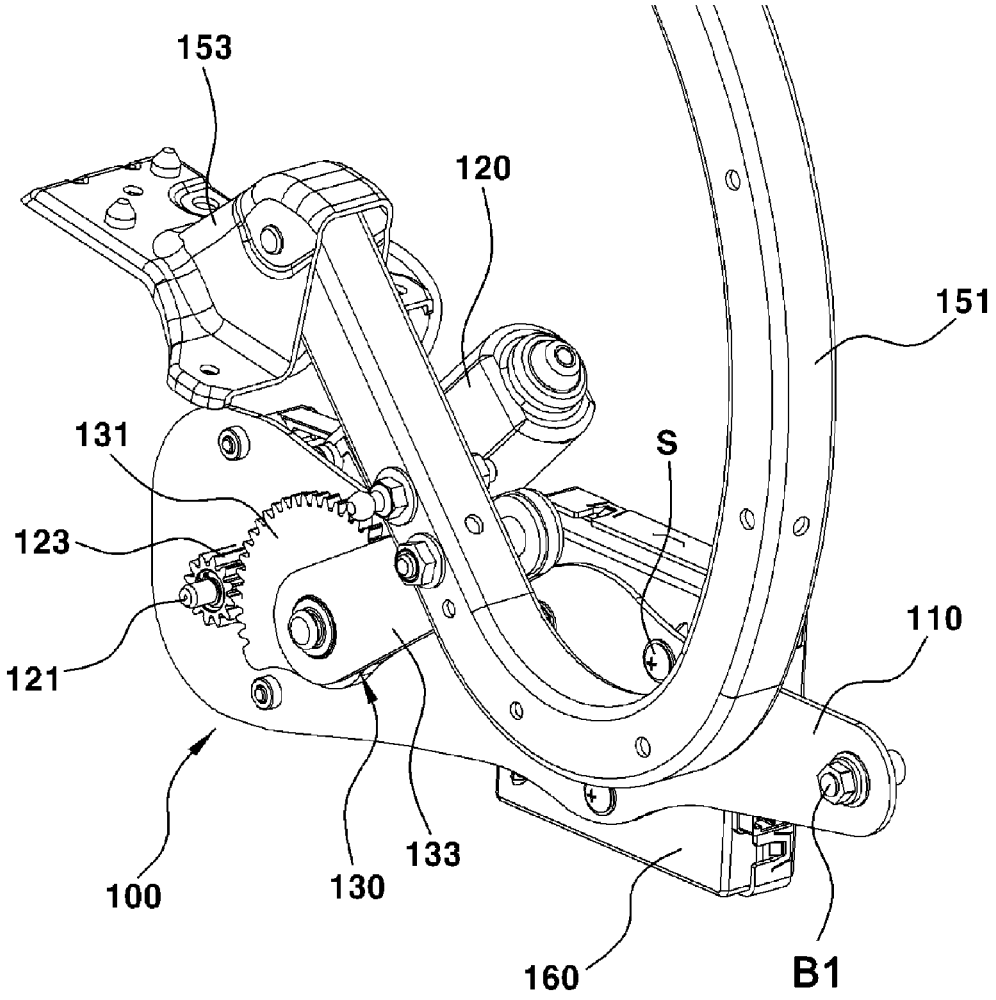
FIG. 4 is a configuration diagram of a driving module of a power trunk according to the present invention.
Figure 5:
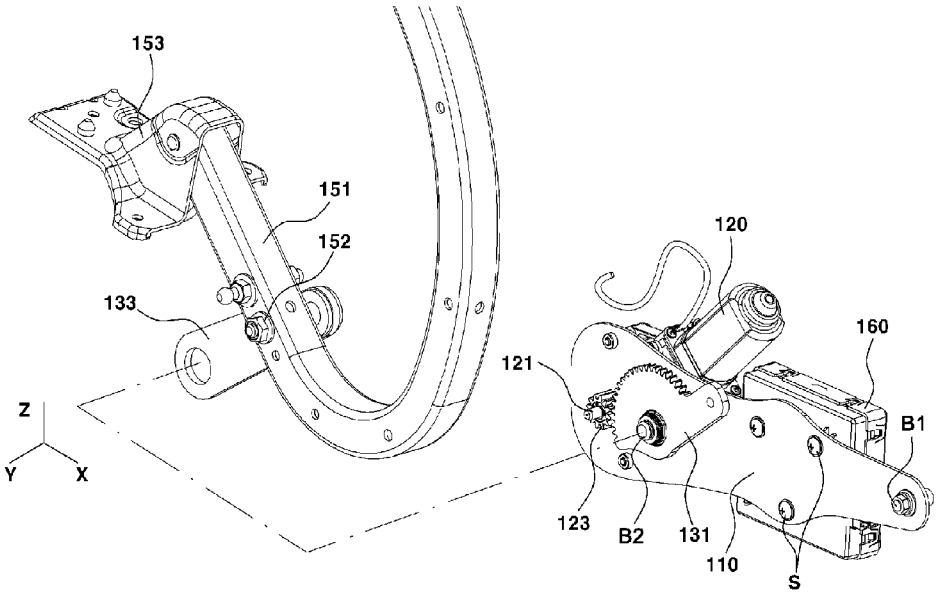
FIG. 5 is a separation configuration diagram of the driving module of a power trunk according to the present invention.
Figure 6:
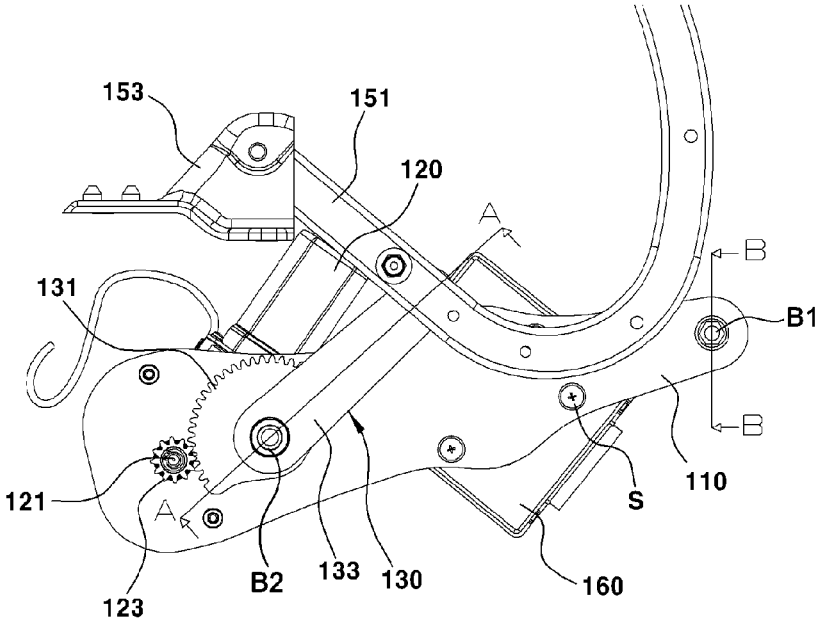
FIG. 6 is a side configuration diagram of the driving module of a power trunk according to the present invention.
Figure 7A:
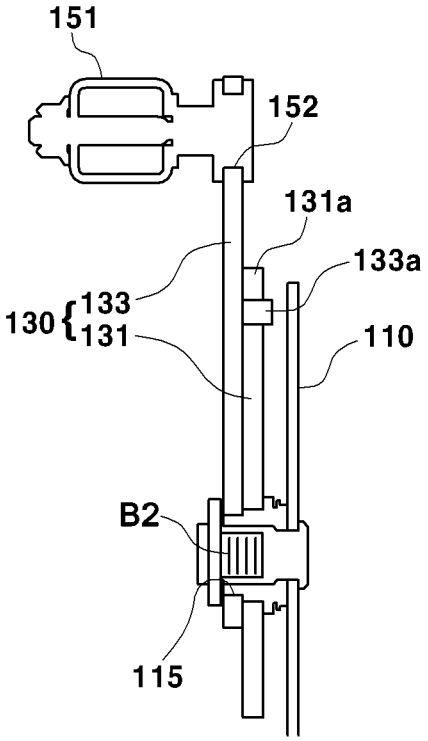
FIGS. 7A and 7B are cross-sectional configuration views, respectively taken along lines A-A and B-B of FIG. 6, of the driving module of a power trunk according to an embodiment of the present invention.
Figure 7B:
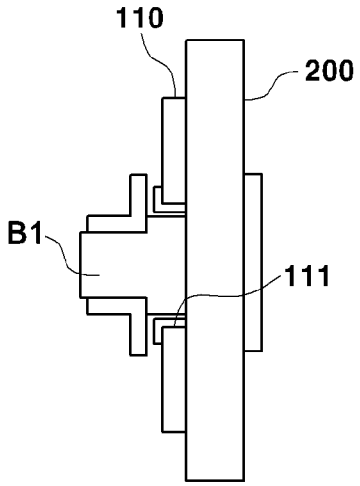
Figure 8:
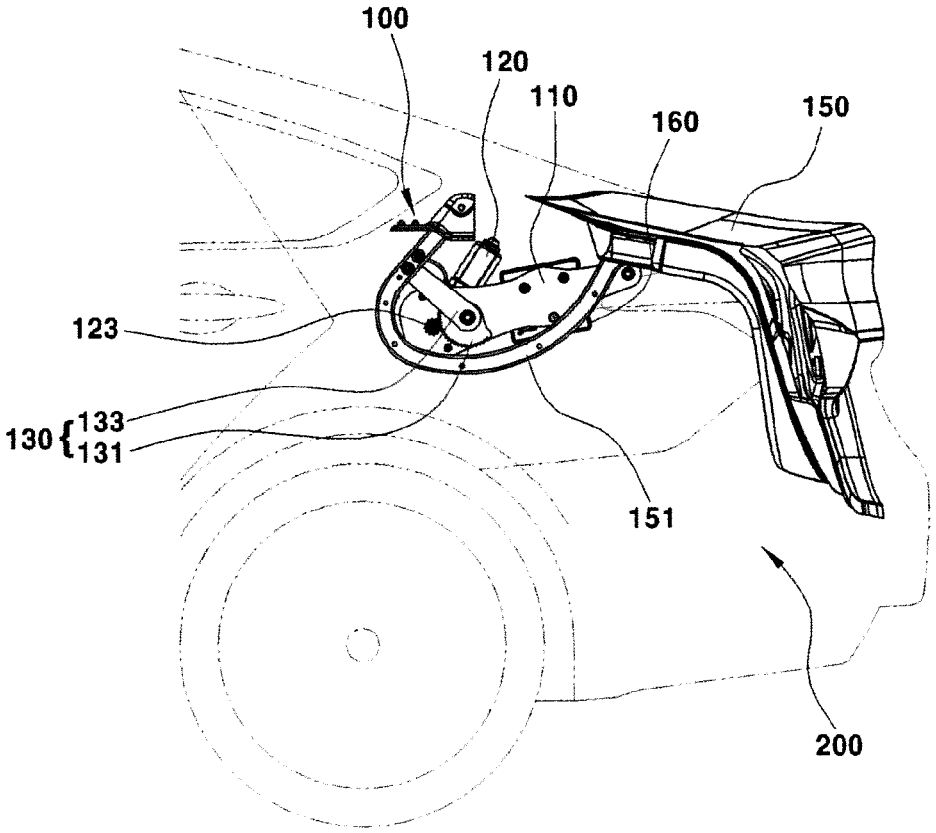
FIGS. 8 and 9 are installation operation state diagrams of the driving module of a power trunk according to the present invention.
Figure 9:
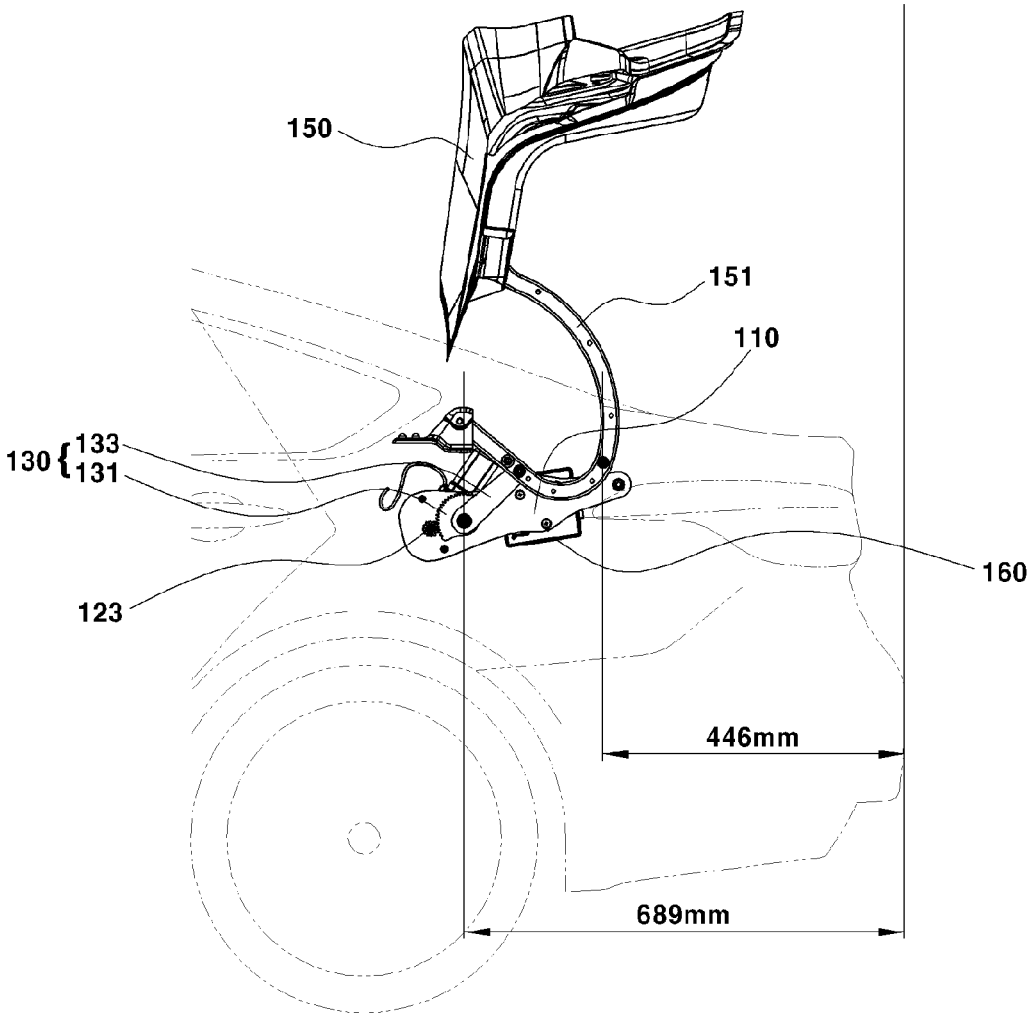

First, according to FIG. 2, in the related art, an operator needs to finally fix the PTL to the vehicle body 200 by deeply entering up to 975 mm which is an innermost side of the trunk, while according to the embodiments shown FIGS. 8 and 9, since the finally operator fastens and fixes the PTL by maximally entering up to 689 mm, it can be seen that working efficiency is even higher than the related art and the weight is reduced by removing a bracket for installing the PTL to significantly reduce a burden in installation work.

Figure 10A:
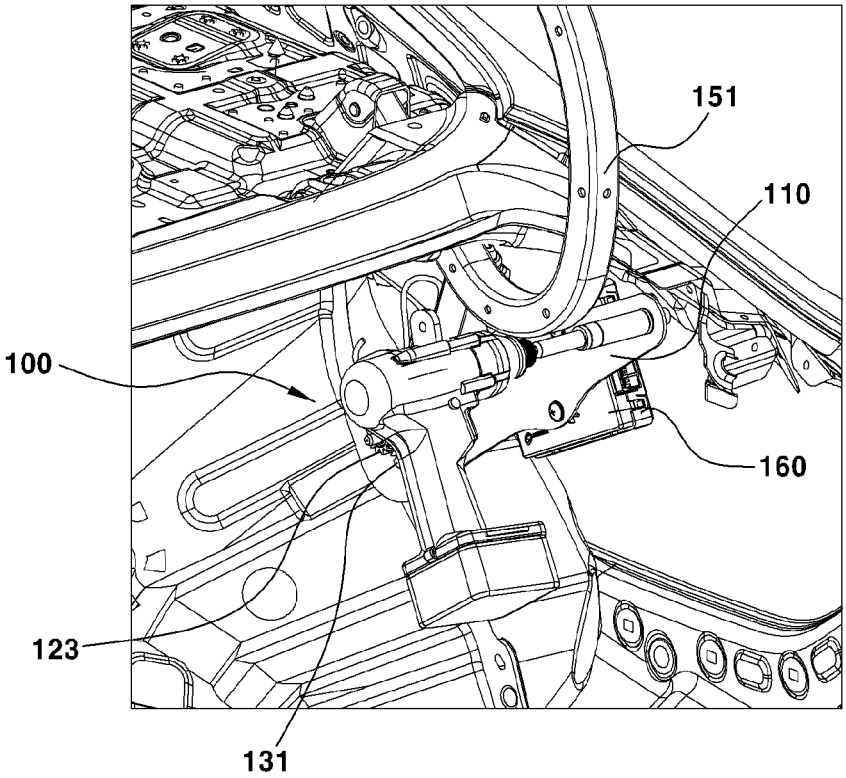
FIGS. 10A and 10B are exemplary diagrams depending on an installation process of the driving module of a power trunk according to the present invention.
Figure 10B:
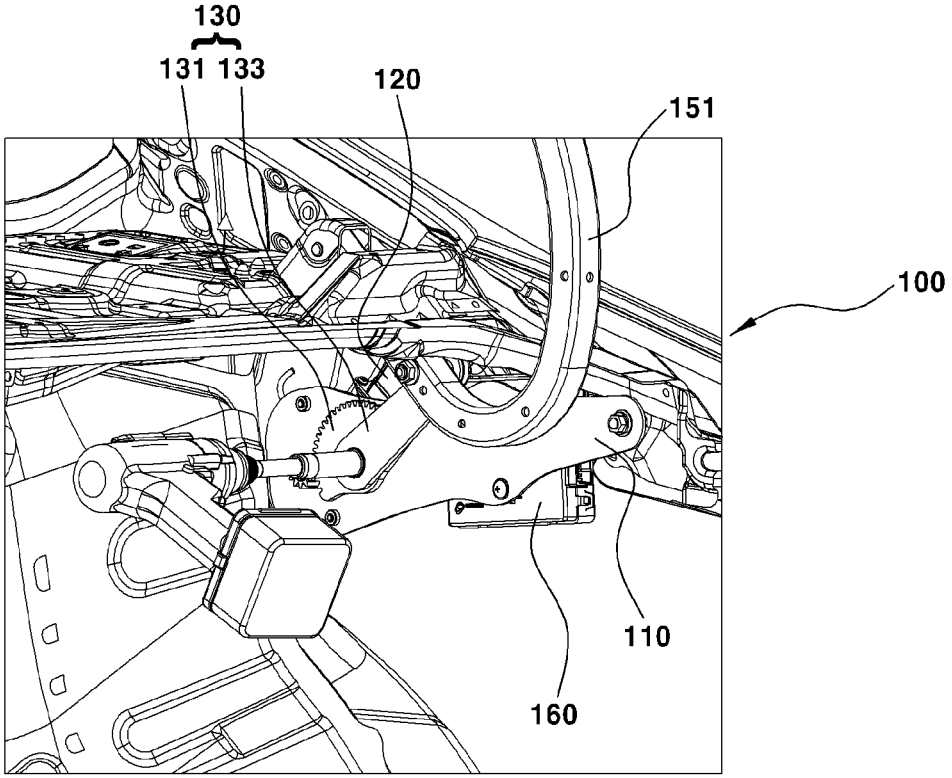

Meanwhile, according to an embodiment shown in FIGS. 10A and 10B, the motor 120, the driving gear 123, and the sector gear 131 are manufactured with being integrally coupled, and as a result, provisional installation in the vehicle body 200 is completed as illustrated in FIG. 10A and the sub arm 130 previously fastened to the lid hinge 151 is fastened to the sector gear 131, and as a result, installation is completed only by fastening of two points as illustrated in FIG. 10B.

In certain embodiments, a second through hole formed in which the motor shaft 121 of the motor 120 is penetratively formed for penetrative coupling to the main arm 110. Reference numeral 153 represents a hinge bracket, which in certain embodiments is fixedly installed in the vehicle body 200 as a rotational center shaft portion of the lid hinge 151 for opening/closing the trunk lid 150.

The embodiments of the present invention configured as above are provided to enhance unfavorable workability depending on an illogical assembly location in the related art, and save a weight depending on deletion of a base plate and save cost thereby.

Terms or words used in the present specification and claims, which will be described below should not be interpreted as being limited to typical or dictionary meanings, but should be interpreted as having meanings and concepts which comply with the technical spirit of the present invention, based on the principle that an inventor can appropriately define the concept of the term to describe his/her own invention in the best manner.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A driving module of a motor-driven power trunk lid in a vehicle, the driving module comprising:

a pivotable lid hinge configured to open or close the power trunk lid;

a main arm pivotably installed in a body of the vehicle;

a sub arm constraining the lid hinge and linked to the main arm; and a motor provided on the main arm and configured to drive the main arm and the sub arm pivoting around a first through hole and a first hinge hole of the main arm, respectively, such that the power trunk lid is automatically opened and closed, wherein the main arm having opposing first and second ends includes, the first through hole formed in the first end of the main arm, and configured to receive a first fastening bolt and fasten the main arm to the body of the vehicle such that the main arm pivots around the first through hole; and a second through hole formed in the second end of the main arm, and configured to receive a motor shaft of the motor in which an axis of the motor shaft is coaxial with an axis of a driving gear of the motor, and wherein the sub arm comprises:

a sector gear, of which an axis is coaxial with an axis of the first hinge hole of the main arm by a second fastening bolt, configured to engage with the driving gear of the motor and rotate by a driving force of the motor, the sector gear having a fixation hole; and a link rod having one end portion linked to a second hinge hole of the lid hinge such that the lid hinge pivots around the second hinge hole by rotation of the sector gear, the link rod having a fixation protrusion corresponding to and coupled to the fixation hole of the sector gear such that the link rod is configured to rotate together with the sector gear.

2. The driving module of claim 1, further comprising:

an electronic control unit (ECU) disposed adjacent to the motor on one surface of the main arm and configured to supply power and transmit a command signal to drive the motor.

3. The driving module of claim 2, wherein:

the main arm has a shape that widens from the first through hole to the second through hole, and multiple fastening holes are formed in the main arm, the multiple fastening holes configured to receive at least one fixation screw configured to fasten the main arm to the motor or the ECU.

4. The driving module of claim 2, wherein the main arm is a bottle-gourd shaped plate.

* * * * *